US006485166B1

(12) United States Patent
Fouke

(10) Patent No.: US 6,485,166 B1
(45) Date of Patent: Nov. 26, 2002

(54) PLASTIC GLOBE FOR USE IN LIGHTING APPLICATIONS AND METHOD OF MAKING SAME

(75) Inventor: Herbert A. Fouke, Newark, OH (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 09/702,434

(22) Filed: Oct. 31, 2000

(51) Int. Cl.[7] ..... F21V 5/02
(52) U.S. Cl. ..... 362/340; 362/363
(58) Field of Search ..... 362/809, 363, 362/340, 362; 442/22

(56) References Cited

U.S. PATENT DOCUMENTS

| | | | | | |
|---|---|---|---|---|---|
| 679,771 | A | * | 8/1901 | Mygatt | 362/340 |
| 762,926 | A | * | 6/1904 | Mygatt | 362/340 |
| 1,299,936 | A | * | 4/1919 | Harrison | 362/311 |
| 1,371,761 | A | * | 3/1921 | Halvorson, Jr. | 362/343 |
| 3,329,812 | A | * | 7/1967 | Harling | 362/223 |
| 3,886,347 | A | * | 5/1975 | Dorman | 362/311 |
| 5,434,765 | A | * | 7/1995 | Kelly et al. | 362/271 |
| 5,584,556 | A | * | 12/1996 | Yokoyama et al. | 349/62 |
| 5,743,634 | A | * | 4/1998 | Sitzema et al. | 362/296 |
| 6,129,759 | A | * | 10/2000 | Chambers | 623/6.11 |
| 6,234,649 | B1 | * | 5/2001 | Katougi | 362/227 |

* cited by examiner

*Primary Examiner*—Sandra O'Shea
*Assistant Examiner*—Hargobind S. Sawhney
(74) *Attorney, Agent, or Firm*—Kenneth E. Darnell

(57) ABSTRACT

An automated method as system for verifying end-to-end connectivity in a broadcast network such as an xDSL network including a plurality of elements such as ATM switches coupled to a subscriber modem. The method and system includes determining each of the elements in the network and establishing a communication channel with a corresponding interface of each element to generate test commands and elicit responsive data. Service logic is applied to determine the location of a fault and display the same on a Graphical User Interface (GUI) in a suitable format such as a Visual Word Document (VWD).

43 Claims, 2 Drawing Sheets

Fig. 1
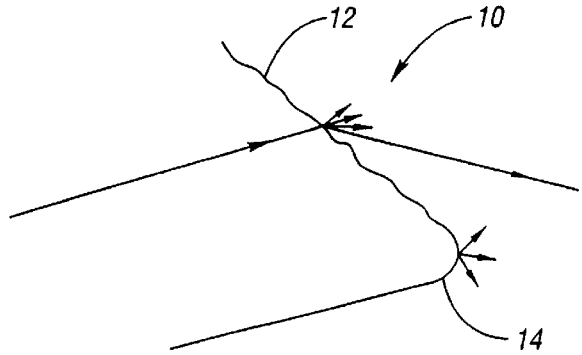
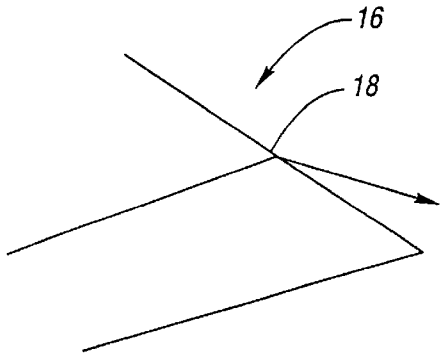
Fig. 2
Fig. 3
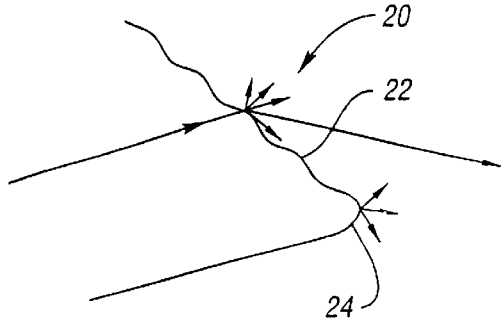
Fig. 4
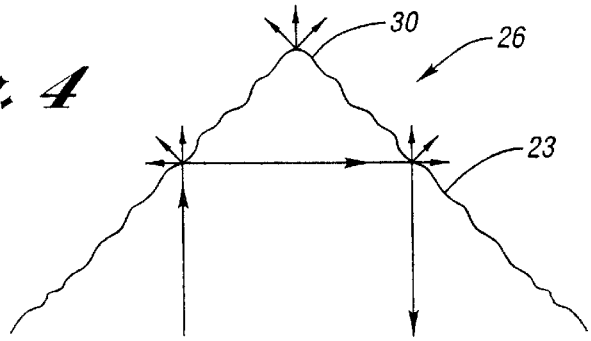

PLASTIC GLOBE FOR USE IN LIGHTING APPLICATIONS AND METHOD OF MAKING SAME

TECHNICAL FIELD

This invention relates to a plastic globe for use in lighting applications and a method of manufacturing the same.

BACKGROUND ART

Outdoor luminaires such as High Intensity Discharge (HID) lighting fixtures include an optical unit also called a "globe" which functions to protect the enclosed light source and redirect light in a manner desired by the lighting designer. Light redirection is typically accomplished by means of reflecting and/or refracting prisms disposed on inner and/or outer surfaces of the globe to reflect and refract light rays respectively. Such globes must, of course, be at least partially translucent and are therefore formed of glass or plastic.

Glass globes have heretofore been preferred by lighting designers because of their superior longevity and appearance. Greater longevity arises because glass typically has greater resistance to sunlight and inclement weather and is therefore less likely to discolor or "yellow" as a result of exposure. As a material, glass provides a superior appearance because of the phenomena known as "glow" or "sparkle" which arises from small amounts of light passing through textured surfaces and corners of prismatic structures disposed on the light emitting surfaces of the globe. As those skilled in the art will recognize, this phenomena is unique to glass and arises as a result of the manufacturing process specifically the prismatic structures are imparted with slight radii or "rounded corners" due to the high viscosity of the glass material during formation of the globe. The light emitting surfaces are further imparted with a surface texture due to "heat checks" or small fissures in the surface metal of the cast iron forming molds due to wear, polishing, and material build up.

Plastic, in contrast, becomes very fluid with a relatively low viscosity during the molding process. This allows very small details to be created and repeated during manufacturing. Accordingly, very sharp corners can be reproduced in prismatic structures Plastic parts are also typically injection molded using highly polished steel resulting in smooth surfaces on the plastic globe. In addition, the wear of the surfaces is minimal, thus maintaining the smooth surfaces. Accordingly, while plastic globes can be manufactured at substantially lower weight, with greater precision and with perhaps greater performance properties then glass, plastic has a noticeably different appearance.

Consequently a need exists for a plastic globe and a method of manufacturing the same which overcomes the above-mentioned difficulties resulting in a globe having an aesthetically pleasing appearance which emulates the "sparkle" or "glow" of glass, when in use.

DISCLOSURE OF INVENTION

It is the principal object of the present invention to provide a plastic globe for use in lighting applications which emulates the appearance of glass during operation of the corresponding lighting fixture.

In carrying out the above object, there is provided a method of manufacturing a plastic globe which.comprises imparting a surface texture, preferably a somewhat rough surface, to at least a portion of one surface of the globe. The texture is imparted by etching the globe itself and/or etching corresponding mold surfaces prior to forming the globe. The method may further comprise alone, or in combination with the above etching, forming a plurality of prisms on at least one surface of the globe With a plurality of the prisms each having a corner with at least one radius to permit light to leak through during use.

These and other objects, features, and advantages of the present invention will become more readily apparent by reference to the following description of the drawings wherein like reference numerals correspond to like components.

BRIEF DESCRIPTION OF DRAWINGS

FIG. 1 is a schematic diagram of a typical refracting prism in glass;

FIG. 2 is a schematic diagram of a typical refracting prism in plastic;

FIG. 3 is a schematic diagram of a textured refracting prism in plastic in accordance with the present invention and having a rounded corner;

FIG. 4 is a schematic diagram of a typical glass reflecting prism;

BEST MODE FOR CARRYING OUT THE INVENTION

Figure 5:
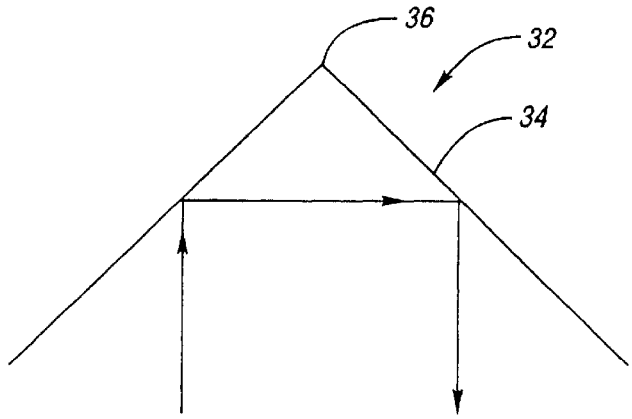
FIG. 5 is a schematic diagram of a typical plastic reflecting prism.

As indicated above, the present invention is directed to a plastic globe for use in lighting applications and a method of manufacturing the same for use in lighting applications. The plastic globe is intended to emulate the appearance of glass and, more particularly, to achieve the "sparkle" or "glow" which has, heretofore, been uniquely associated with glass globes.

In keeping with the invention, any suitable plastic material may be used depending upon the needs of the lighting designer including, without limitation, acrylic such as, for example, V825-HID produced by Elf Atochem. This material is known to those skilled in the art and is available to numerous plastic molders. While other plastic materials such as poly-carbonate may be used, it is presently considered undesirable because the long-term exposure of such material to ultraviolet light in high temperatures has proven to be unacceptable to customers.

As indicated above, "glow" or "sparkle" typically results in glass globes as a result of small amounts of light passing through textured surfaces and rounded corners of prismatic structures disposed on the light emitting surfaces of the corresponding globe. Both the surface texture and the rounded corners of the prismatic structure arise as a result of the manufacturing process due to the high viscosity of glass and "heat checks" or fissures in the forming molds as a result of wear, polishing and material build up.

A typical refracting prism in glass is shown, for example, in FIG. 1 of the drawings and designated generally by reference numeral 10. As seen, the surface 12 of the glass prism has a texture that diffuses some of the light passing through the prism. Also, the peak 14 of the prism 10 is rounded, allowing some of the light to leak through the peak and be diffused. Conversely, a typical plastic refracting prism 16 in plastic is shown in FIG. 2. As seen, the smooth surface 18 of this prism does not diffuse the light passing through it.

Referring now to FIG. 3 of the drawings, there is shown a schematic diagram of a plastic refracting prism 20 in accordance with the present invention. This refracting prism, which may be disposed on all or any portion of an inside or outside surface of the plastic globe and includes a textured surface 22 which functions to diffuse or scatter light in much the same way as the glass prism 12 of FIG. 1. This surface texture can be achieved in one or more ways. For example, the plastic globe itself may be treated or "etched" such as, for example, by chemical etching subsequent to the forming process. Alternatively, the plastic mold itself may be etched such as, for example, by acid etching or Electric Discharge Machining (EDM) to achieve the same fissures typically seen in glass molds as a result of wear. As indicated above, since plastic products are typically injection molded using stainless steel molds which are less porous than cast iron glass molds, such "heat checks" or "texture" rarely occur. In keeping with the invention, FIG. 3 also shows the effect of rounding the peaks 24 of the prism. Although any suitable radius may be used depending upon the application and the desired performance, Applicants have found that in a preferred embodiment, the prism peaks 24 use a radius in the range 0.010 to 0.030 inches. Both of these features, texture and rounded corners which result in at least one radius thereof, permit light to be diffused or scattered causing the prisms to emulate the "sparkle" or "glow" appearance of glass.

Turning now to FIG. 4 of the drawings, a typical glass reflecting prism 26 is shown. As seen, the textured surface 23 of the glass prism 26 allows some of the light to be emitted rather than reflected thus imparting a "glow". Again, some of the light is also emitted through the rounded peak 30 of the prism. A typical reflecting prism in plastic 32 is similarly shown in FIG. 5. Again, the smooth surface 34 and sharp corners 36 of the prism 32 allow most of the light to be reflected and very little to be emitted through the prism. Thus, the section of the product using plastic reflecting prisms appears darker than when glass prisms are used.

Figure 6:
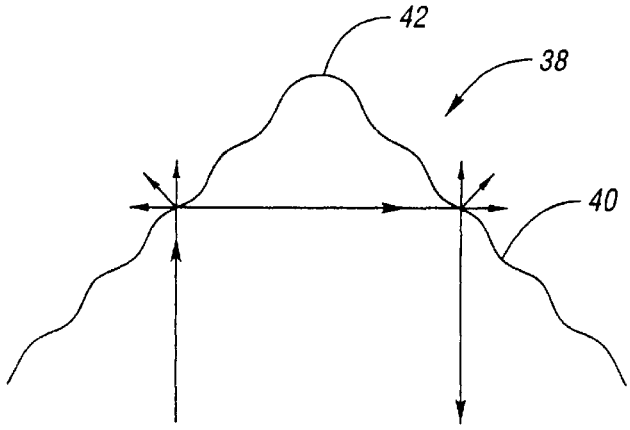
FIG. 6 is a schematic diagram of a textured plastic reflecting prism in accordance with the present invention and having a rounded corner.

FIG. 6 of the drawings illustrates a plastic reflecting prism 38 made in accordance with the present invention. Again, the surface 40 is textured and the peaks 42 of the prisms 38 may also be rounded thus allowing some light to be emitted from the prism and causing the section of the product made in plastic to emulate the "glow" or "sparkle" of glass when in use.

Figure 7:
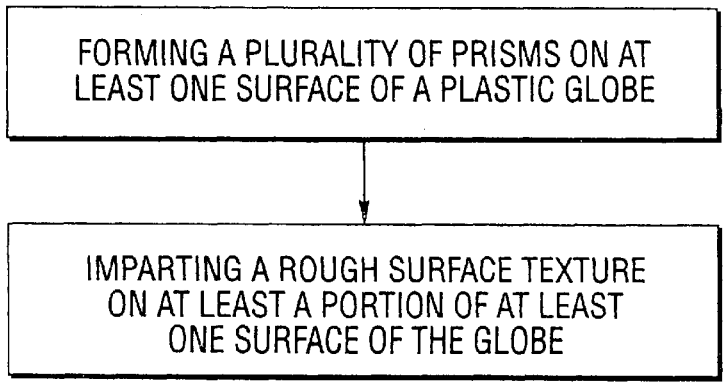
FIG. 7 is a flow diagram illustrating the process flow of the method steps of the present invention.

The generalized method steps of the present invention are provided in FIG. 7 of the drawings. As shown, the method is specifically directed for use in manufacturing a plastic globe for lighting applications having light leak to emulate the appearance of a glass globe. The method comprises forming 44 a plurality of prisms on at least one surface of the globe, a plurality of the prisms having a corner with at least one radius. The method further comprises alone, or in combination with the above step, imparting 46 a substantially rough texture on at least a portion of at least one surface of the globe.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. In a luminaire having a globe formed of a plastic material, the improvement comprising a plurality of prisms disposed on at least portions of a surface of the globe, at least certain of the prisms having a texture formed on surfaces thereof to scatter and diffuse light passing through said prisms to simulate the appearance of a glass globe.

2. In the luminaire of claim 1 wherein the texture is formed on an outside surface of the globe.

3. In the luminaire of claim 1 wherein at least certain of the prisms are reflecting prisms.

4. In the luminaire of claim 1 wherein at least certain of the prisms are refracting prisms.

5. In the luminaire of claim 1 wherein at least certain of the prisms have a corner with at least one radius.

6. In the luminaire of claim 5 wherein at least certain of the prisms are reflecting prisms.

7. In the luminaire of claim 5 wherein at least certain of the prisms are refracting prisms.

8. In the luminaire of claim 1 wherein at least certain of the prisms have a rounded corner.

9. In the luminaire of claim 8 wherein at least certain of the prisms are reflecting prisms.

10. In the luminaire of claim 8 wherein at least certain of the prisms are refracting prisms.

11. In the luminaire of claim 1 wherein the plurality of prisms are disposed on an outer surface of the globe.

12. In the luminaire of claim 1 wherein the texture formed on surfaces of the prisms is a roughened texture.

13. In the luminaire of claim 1 wherein the texture formed on surfaces of the prisms takes the form of ripples.

14. In the luminaire having a globe formed of a plastic material, the improvement comprising:

a plurality of prisms disposed on at least one surface of the globe, at least certain of the prisms having a corner with at least one radius a texture formed on at least a portion of a surface of the globe, thereby to scatter and diffuse light passing through surfaces of the globe to simulate the appearance of a glass globe.

15. In the luminaire of claim 14 wherein at least certain of the prisms have a rounded corner.

16. In the luminaire of claim 14 wherein the texture is formed on surfaces of the prisms.

17. In the luminaire of claim 16 wherein the texture formed on surfaces of the prisms is a roughened texture.

18. In the luminaire of claim 16 wherein the texture formed on surfaces of the prisms takes the form of ripples.

19. In the luminaire of claim 14 wherein at least certain of the prisms are reflecting prisms.

20. In the luminaire of claim 14 wherein at least certain of the prisms are refracting prisms.

21. In a luminaire having a body member formed of a plastic material through which light passes to the exterior of the luminaires the improvement comprising a plurality of prisms disposed on a surface of the body member, at least certain of the prisms having a texture formed on surfaces thereof to scatter and to diffuse at least a portion of the fight passing through said prisms to simulate the appearance of a glass body member.

22. In the luminaire of claim 21 wherein the texture is formed on an outside surface of the body member.

23. In the luminaire of claim 21 wherein at least certain of the prisms are reflecting prisms.

24. In the luminaire of claim 21 wherein at least certain of the prisms refracting prisms.

25. In the luminaire of claim 21 wherein at least certain of the prisms have a corner with at least one radius.

26. In the luminaire of claim 25 wherein at least certain of the prisms are reflecting prisms.

27. In the luminaire of claim 25 wherein at least certain of the prisms are refracting prisms.

28. In the luminaire of claim 21 wherein at least certain of the prisms have a rounded corner.

29. In the luminaire of claim 28 wherein at least certain of the prisms are reflecting prisms.

30. In the luminaire of claim 28 wherein at least certain of the prisms are refracting prisms.

31. In the luminaire of claim 21 wherein the plurality of prisms are disposed on an outer surface of the body member.

32. In the luminaire of claim 21 wherein texture formed on surfaces of the prisms is a roughened texture.

33. In the luminaire of claim 21 wherein the texture formed on surfaces of the prisms takes the form of ripples.

34. A method of manufacturing a body member used in a luminaire, the body member being formed of a plastic material through which light passes to the exterior of the luminaire, the method comprising:

forming a plurality of prisms on a surface of the body member, surfaces of at least certain of the prisms having a roughened texture formed thereon.

35. The method of claim 34 and further comprising the step of rounding corners of at least certain of the prisms.

36. The method of claim 34 and further comprising the step of forming corners of at least certain of the prisms to have at least one radius.

37. The method of claim 34 wherein the texture is imparted by electric discharge machining of said surfaces of at least certain of the prisms.

38. A method of manufacturing a body member used in a luminaire, the body member being formed of a plastic material through which light passes to the exterior of the luminaire, the method comprising:

forming a plurality of prisms on at least portions of surfaces of the body member; and, forming a texture on surfaces of at least certain of the prisms.

39. The method of claim 38 and firer comprising the step of rounding corners of at least certain of the prisms.

40. The method of claim 38 and further comprising the step of forming corners of at least certain of the prisms to have at least one radius.

41. The method of claim 38 wherein the texture is imparted by chemical etching of the body member.

42. The method of claim 38 wherein the body member is formed in a mold, the texture being imparted by etching of at least a portion of surfaces of the mold that contact portions of surfaces of the body member to which texture is imparted.

43. The method of claim 42 wherein the etching is imparted by electric discharge machining.

* * * * *

UNITED STATES PATENT AND TRADEMARK OFFICE

CERTIFICATE OF CORRECTION

PATENT NO. : 6,485,166 B1
DATED : November 26, 2002
INVENTOR(S) : Herbert A. Fouke It is certified that error appears in the above-identified patent and that said Letters Patent is hereby corrected as shown below:

Title page,
Item [57], ABSTRACT, please delete the ABSTRACT that appears on the face of the patent and insert the following:

-- ABSTRACT

Plastic globes intended to house light sources in lighting applications such as decorative street lighting and being formed by conventional processes of polymeric materials such as an acrylic "plastic", the globes of the invention are textured on surfaces thereof to scatter and diffuse light passing therethrough to simulate an aesthetically pleasing appearance of a globe formed of glass. In particular embodiments, prisms formed on surfaces of such plastic globes are textured and/or formed with rounded corners to produce the appearance of a glass globe. --

Signed and Sealed this

Twenty-second Day of April, 2003

JAMES E. ROGAN
*Director of the United States Patent and Trademark Office*